US007302170B1

(12) United States Patent
Chen

(10) Patent No.: US 7,302,170 B1
(45) Date of Patent: Nov. 27, 2007

(54) HEATING DEVICE FOR SMOKE GENERATOR

(76) Inventor: Zhao-Liang Chen, 6th Floor, No. 18, Dadun 13th St., Taichung (TW)

( * ) Notice: Subject to any disclaimer, the term of this patent is extended or adjusted under 35 U.S.C. 154(b) by 0 days.

(21) Appl. No.: 11/277,170

(22) Filed: Mar. 22, 2006

(51) Int. Cl.
*F22B 29/06* (2006.01)

(52) U.S. Cl. ..... 392/398; 392/399; 392/400

(58) Field of Classification Search ..... None
See application file for complete search history.

(56) References Cited

U.S. PATENT DOCUMENTS 1,615,166 A * 1/1927 Cowles ..... 392/481
2,576,558 A * 11/1951 Bede ..... 392/495
3,990,987 A * 11/1976 Rogers ..... 73/170.04
4,308,636 A * 1/1982 Davis ..... 15/321
4,465,922 A * 8/1984 Kolibas ..... 392/484
4,480,172 A * 10/1984 Ciciliot et al. ..... 392/396
4,818,843 A * 4/1989 Swiatosz ..... 392/397
4,871,115 A * 10/1989 Hessey ..... 239/136
5,265,318 A * 11/1993 Shero ..... 29/447

* cited by examiner

*Primary Examiner*—Thor S. Campbell
(74) *Attorney, Agent, or Firm*—Alan Kamrath; Kamrath & Associates P.A.

(57) ABSTRACT

A heating device for a smoke generator includes at least one heating rod and a vaporization tube. The vaporization tube includes a longitudinal passageway. The vaporization tube coils around the heating rod and includes an end connected to an outlet of a pump of a smoke generator. Preferably, the vaporization tube helically coils around the heating rod to form a coiling structure having at least one layer. Preferably, the vaporization tube includes a non-circular cross-section having at least one side in surface contact with a circumference of the heating rod.

8 Claims, 5 Drawing Sheets

HEATING DEVICE FOR SMOKE GENERATOR

BACKGROUND OF THE INVENTION

1. Field of the Invention

The present invention relates to a heating device. More particularly, the present invention relates to a heating device for a smoke generator.

2. Description of the Related Art

Stage lamps and/or smoke are generally provided for better entertainment effect. Smoke is generated by smoke generators. A typical stage smoke generator comprises a pump for sucking oil in an oil tank into a channel. The smoke generator further includes a heating device having a heating rod for heating and thus vaporizing the oil in the channel. The vaporized oil (or smoke) is ejected through a nozzle to obtain a smoke effect.

In a conventional design of the heating device, the vaporization tube is obtained by processing aluminum material, and the heating rod is then inserted into the vaporization tube. Two ends of the vaporization tube are respectively connected to an outlet of the pump and the nozzle. However, the vaporization tube has many joints and thus requires troublesome processing and is liable to be blocked in the joints.

In another conventional design of the heating device, the metal body of the heating device is wrapped around a helical vaporization tube by casting, with two ends of the vaporization tube exposed outside the metal body and respectively connected to the outlet of the pump and a smoke outlet. The helical vaporization tube enhances the heat-conducting effect and increases the travel of the oil for vaporization. However, the structure and the manufacturing method of the heating device are complicated and, thus, costly.

In both conventional designs, the smoke ejecting efficiency is unsatisfactory and the vaporization tube is liable to be blocked. The temperature distribution in the vaporization tube is not uniform, resulting in overheating or underheating. Further, the travel of vaporization of oil is not long enough, leading to ejection of oil due to incomplete vaporization or over-vaporization with a smell of burn. As a result, blocking occurs easily. Further, the manufacturing procedure of the heating device is troublesome and material waste is inevitable, leading to an increase in the cost.

BRIEF SUMMARY OF THE INVENTION

An objective of the present invention is to provide a heating device for a smoke generator that has a simplified structure, that can be manufactured at a low cost, and that has improved high smoke ejecting efficiency.

A heating device for a smoke generator in accordance with the present invention comprises at least one heating rod and a vaporization tube. The vaporization tube includes a longitudinal passageway. The vaporization tube coils around the at least one heating rod and includes an end adapted to be connected to an outlet of a pump of a smoke generator.

Preferably, the at least one heating rod is a substantially cylindrical electric heating rod.

Preferably, the vaporization tube helically coils around the at least one heating rod to form a coiling structure having at least one layer, with another end of the vaporization tube adapted to extend through a casing of the smoke generator to an outside of the smoke generator.

Preferably, the vaporization tube includes a non-circular cross-section having at least one side in surface contact with a circumference of the at least one heating rod.

Preferably, the cross-section of the vaporization tube is rectangular, triangular, or polygonal.

Preferably, a heat-insulating layer wraps around the vaporization tube.

Other objectives, advantages, and novel features of the invention will become more apparent from the following detailed description when taken in conjunction with the accompanying drawings.

DETAILED DESCRIPTION OF THE INVENTION

Figure 1:
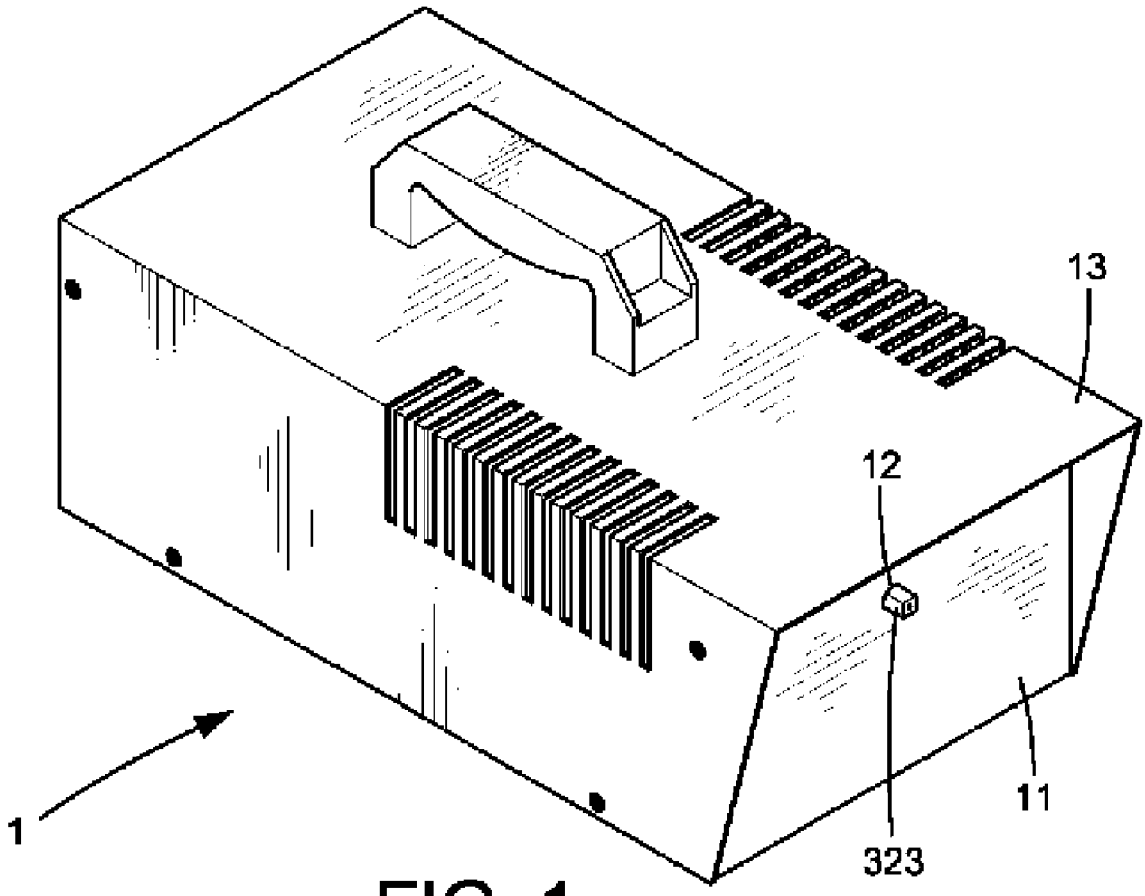
FIG. 1 is a perspective view of a smoke generator with a heating device in accordance with the present invention.

FIGS. 1 through 4 illustrate a smoke generator with an embodiment of a heating device 3 in accordance with the present invention. The smoke generator comprises a casing 1, an oil tank 2, and a heating device 3. The casing 1 and the oil tank 2 may be of conventional design.

The casing 1 includes a base 10 and two end plates 11, and a cover 13 is mounted on top of the base 10 and forms the top side and two lateral sides of the casing 1. A compartment 14 for receiving the oil tank 2 and the heating device 3 is thus defined in the casing 1.

The oil tank 2 receives oil for producing smoke. An oil pipe 21 extends from the oil tank 2 and is connected to a pump 22 at an outer end. The pump 22 is mounted on the base 10 and beside the heating device 3. The pump 22 is connected via a wire (not shown) to a circuit board (not shown) for controlling pumping of oil out of the oil tank 2.

Figure 2:
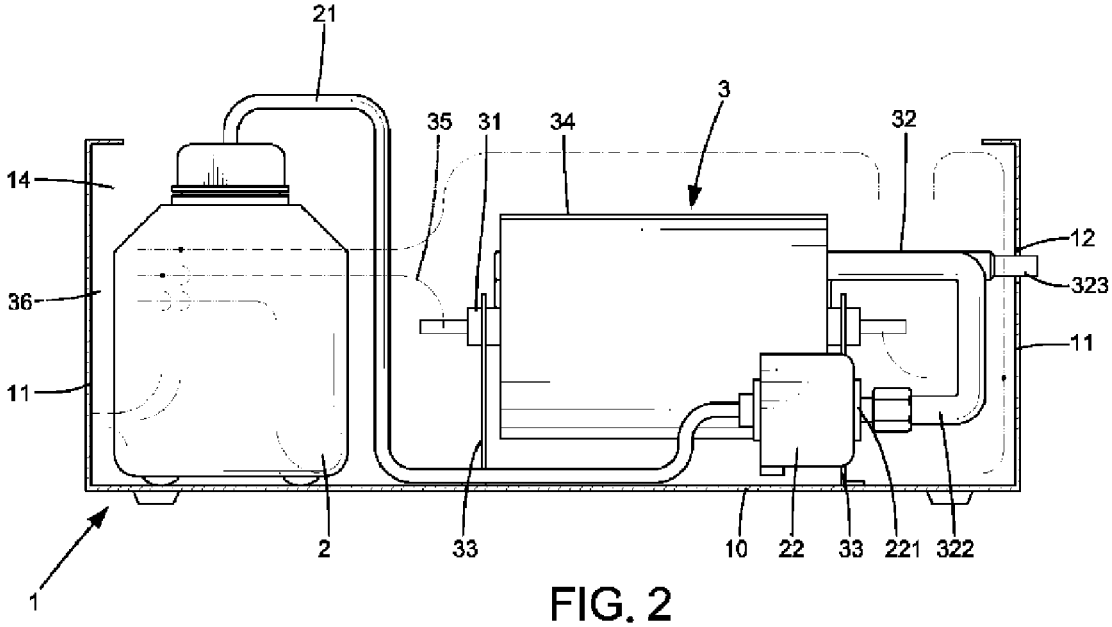
FIG. 2 is a schematic side view, partly sectioned, of the smoke generator in FIG. 1, wherein a cover of the smoke generator is removed.
Figure 3:
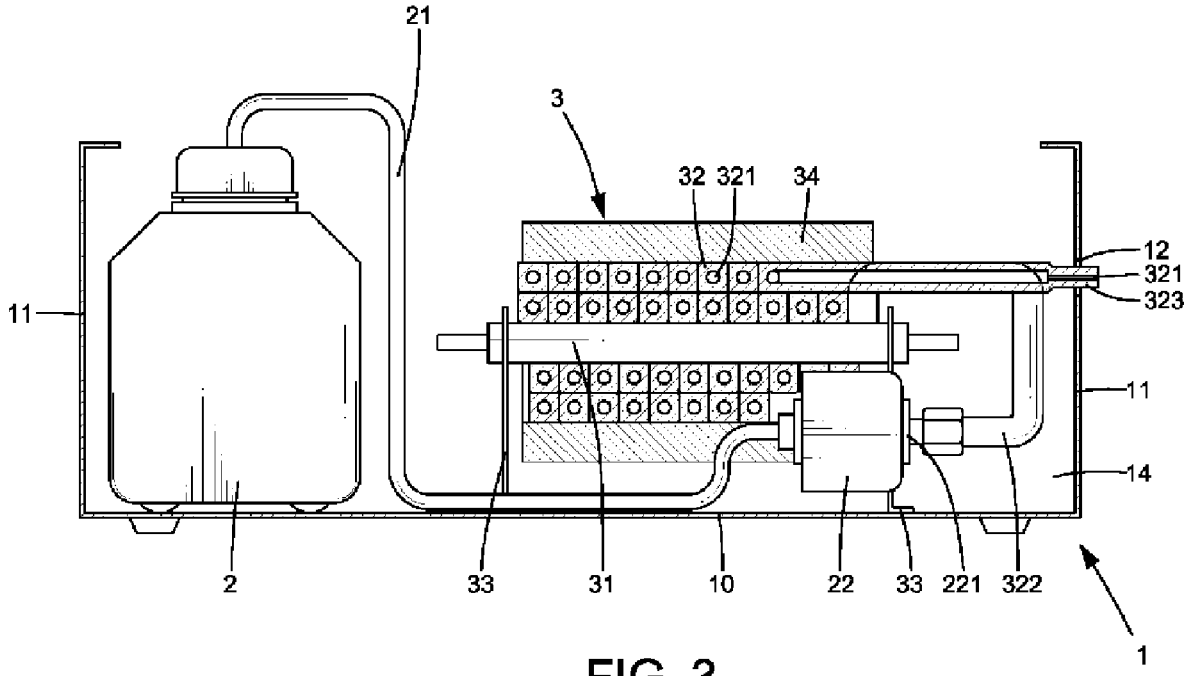
FIG. 3 is a view similar to FIG. 2, wherein a vaporization tube of the heating device is sectioned.
Figure 4:
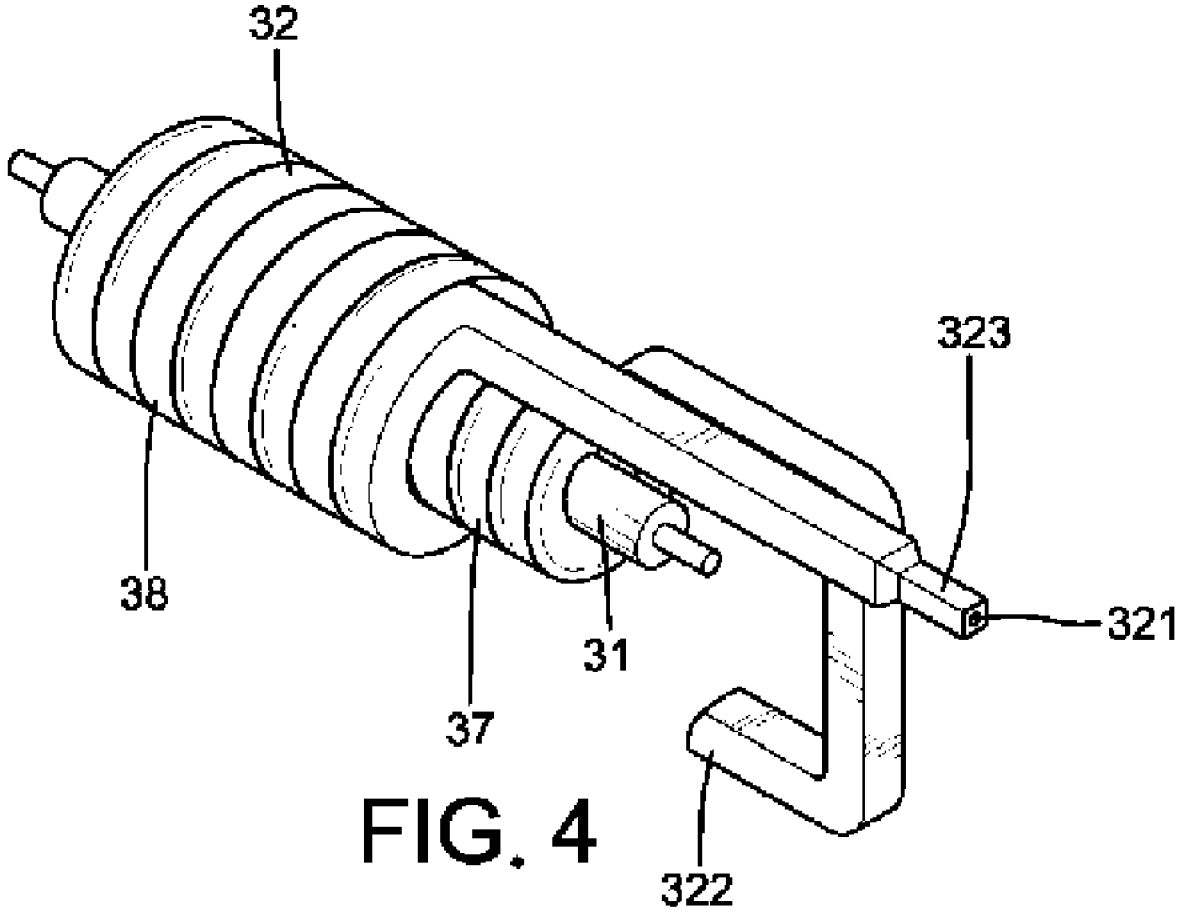
FIG. 4 is a perspective view of the heating device in accordance with the present invention.

Referring to FIGS. 2 through 4, the heating device 3 includes a heating rod 31 and a vaporization tube 32. In the illustrated embodiment, the heating rod 3 is a substantially cylindrical electric heating rod and has two ends connected by wires 35 to a power source 36 or a control panel. Thus, the heating rod 3 is supplied with electricity for heating and thus vaporizing the oil. Each end of the heating rod 3 is supported by a support 33 (FIG. 2).

The vaporization tube 32 is an elongated tube with a longitudinal passageway 321. The vaporization tube 32 coils around the heating rod 31. In this embodiment, the vaporization tube 32 coils around the heating rod 31 twice to provide a two layer structure including an inner coil section 37 and an outer coil section 38. It is noted that the vaporization tube 32 may coil around the heating rod 31 as many times as desired. A first, inner end 322 of the vaporization tube 32 is connected to an outlet 221 of the pump 22, and a second, outer end 323 of the vaporization tube 32 is extended through a through-hole 12 in the casing 1. The vaporization tube 32 may be wrapped by a heat-insulating layer 34 made of heat-insulating material such as heat-insulating cotton.

Preferably, the helical vaporization tube 32 has a non-circular cross-section. Alternatively, the cross-section of the helical vaporization tube 32 has a planar side for intimate surface contact with a circumference of the heating rod 31 for excellent heat conduction purposes. In the illustrated embodiment, the cross-section of the helical vaporization tube 32 is rectangular. Alternatively, the cross-section of the helical vaporization tube 32 may be triangular, polygonal, trapezoidal or any other shape that has a large contact area with the heating rod 31.

In use, the pump 22 pumps the oil out of the oil tank 2 into the passageway 321 in the vaporization tube 32. The heating rod 31 heats the vaporization tube 32 to create a high-temperature environment for the oil. Thus, the oil vaporizes into smoke while passing through the passageway 321 of the vaporization tube 32. The smoke is ejected via the second end 323 of the vaporization tube 32.

Since the vaporization tube 32 coils around the heating rod 31, the travel for oil vaporization is longer. Further, since the vaporization tube 32 has a large contact area with the heating rod 31, the heat conduction efficiency is enhanced. The vaporizing efficiency is enhanced accordingly. Further, the vaporization tube 32 is not coiled around the heating rod 31 by casting, providing a simplified structure while saving the production cost. The coiling arrangement of the vaporization tube 32 may vary according to needs, allowing flexible designs. For example, the vaporization tube 32 may be arranged in rows or in an array in addition to multi-layer concentric coiling (or windings).

Figure 5:
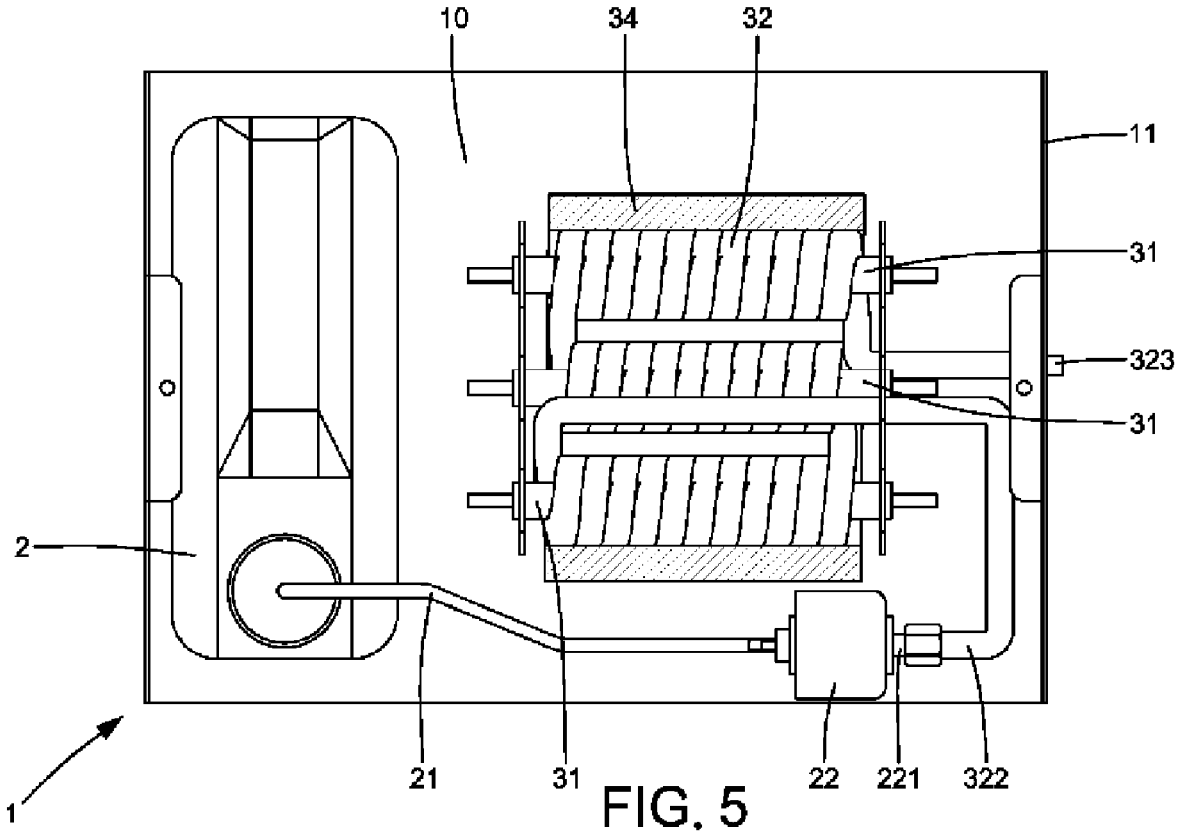
FIG. 5 is a top view illustrating a smoke generator with a modified embodiment of the heating device in accordance with the present invention.

FIG. 5 illustrates a modified embodiment of the invention. In this embodiment, the heating device includes three heating rods 31 placed side by side, with the vaporization tube 32 coiling around the heating rods 31 for enhancing the heating efficiency. As mentioned above, the coiling arrangement of the vaporization tube 32 may vary according to needs.

Although specific embodiments have been illustrated and described, numerous modifications and variations are still possible without departing from the essence of the invention. The scope of the invention is limited by the accompanying claims.

What is claimed is:

1. A smoke generator comprising an oil tank having a port for receiving oil; a pump having an inlet in communication with the oil tank and an outlet; and a heating device, with the heating device comprising a first heating rod and a vaporization tube distinct from the first heating rod, with the vaporization tube including a longitudinal passageway having a first end connected to the outlet of the pump and a second end open to atmosphere, with the vaporization tube coiling around said first heating rod, with the vaporization tube having a central section intermediate the first end and the second end and in surface contact with the first heating rod, with the pump being operable to pump oil from the oil tank and into the first end of the longitudinal passageway of the vaporization tube, with the oil flowing through the longitudinal passageway of the vaporization tube, with the first heating rod heating and vaporizing the oil in the longitudinal passageway, and with the second end of the longitudinal passageway outputting the vaporized oil as smoke, wherein the smoke provides a stage performance effect.

2. The smoke generator as claimed in claim 1 wherein said first heating rod is a substantially cylindrical electric heating rod.

3. The smoke generator as claimed in claim 1 wherein the central section of the vaporization tube helically coils around and is in surface contact with said first heating rod, with a coil section in communication with the central section, and with the coil section helically coiling around and in surface contact with the central section.

4. The smoke generator as claimed in claim 1 wherein the vaporization tube includes an outer periphery with non-circular cross-sections transverse to an oil flow direction, with the vaporization tube having at least one side in surface contact with a circumference of said first heating rod, with the longitudinal passageway defining circular cross-sections transverse to the oil now direction, with each of the circular cross-sections concentric with a corresponding one of the non-circular cross-sections in a same plane transverse to the oil flow direction, and with the longitudinal passageway spaced from the outer periphery of the vaporization tube.

5. The smoke generator as claimed in claim 4 wherein the cross-sections of the vaporization tube are rectangular, triangular, or polygonal.

6. The smoke generator as claimed in claim 1 further comprising a heat-insulating layer wrapping around the vaporization tube.

7. The smoke generator as claimed in claim 1 further comprising a second heating rod mounted beside and spaced from said first heating rod and a coil section in communication with the central section, with the central section of the vaporization tube helically coiling around and in surface contact with said first heating rod and with the coil section helically coiling around and in surface contact with the second heating rod.

8. The smoke generator as claimed in claim 7 further comprising a third heating rod mounted beside and spaced from said second heating rod and a second coil section in communication with the coil section, with the second coil section of the vaporization tube helically coiling around and in surface contact with said third heating rod.

* * * * *